US005287153A

United States Patent [19]

Senba

[11] Patent Number: 5,287,153

[45] Date of Patent: Feb. 15, 1994

[54] FIXING APPARATUS WITH BIASING MEANS TO PREVENT OFFSET

[75] Inventor: Hisaaki Senba, Yokohama, Japan

[73] Assignee: Canon Kabushiki Kaisha, Tokyo, Japan

[21] Appl. No.: 618,399

[22] Filed: Nov. 27, 1990

[30] Foreign Application Priority Data

Dec. 20, 1989 [JP] Japan ..... 1-328162

[51] Int. Cl.[5] ..... G03G 15/20

[52] U.S. Cl. ..... 355/284; 355/290

[58] Field of Search ..... 355/285, 290, 289, 282, 355/284; 219/216

[56] References Cited

U.S. PATENT DOCUMENTS 4,466,732 8/1984 Folkins ..... 118/658 X
4,470,688 9/1984 Inagaki et al. ..... 219/216 X
4,819,020 4/1989 Matsushiro et al. ..... 219/216 X
4,842,944 6/1989 Kuge et al. ..... 355/285 X
4,862,215 8/1989 Nomura et al. ..... 355/284 X
5,045,891 9/1991 Senba et al. ..... 355/289

FOREIGN PATENT DOCUMENTS 0289572 11/1988 Japan ..... 355/284

*Primary Examiner*—Leo P. Picard
*Assistant Examiner*—Christopher Horgan
*Attorney, Agent, or Firm*—Fitzpatrick, Cella, Harper & Scinto

[57] ABSTRACT

A fixing device includes a feed member for performing a fixing operation by grasping and feeding a supporting material supporting an undeveloped toner image. The feed member is made of a conductive base material and a surface release layer provided thereon, the surface release layer containing a conductive material. A biasing voltage is applied to the conductive base material.

6 Claims, 4 Drawing Sheets

FIXING APPARATUS WITH BIASING MEANS TO PREVENT OFFSET

BACKGROUND OF THE INVENTION

1. Field of the Invention

This invention relates to a fixing device for performing a fixing operation wherein feed members, such as rollers, belts and the like, grasp and feed a supporting material on which an unfixed toner image has been deposited.

2. Description of the Related Art

After forming a toner image on a recording material, such as paper or the like, by a method such as the Carlson process in electrophotographic apparatus, the toner image must be fixed as a permanent image. Various methods have been proposed as fixing methods for use in electrophotographic and other image forming apparatus. Recently, from the viewpoint of thermal efficiency and economy, heat-roller fixing devices are frequently used in which a toner image is fused and fixed by grasping and feeding a recording material with a pair of rollers, a fixing roller and a pressing roller, at least one of which has a heating source.

FIG. 5 shows a heat-roller fixing device which comprises a fixing roller 1 having a heating source 8, such as a halogen lamp or the like, and a pressing roller 7 having an elastic layer made of silicone rubber or the like. The pressing roller 7 is in pressure contact with the fixing roller 1. As described above, while the two rollers rotate and a recording material P, such as paper or the like, passes between the rollers, a toner image T fuses by heat and pressure, and cools after leaving the pair of rollers to form a fixed image.

There is also shown a frame 10 for the fixing device.

In such a fixing device, the phenomenon of offset easily occurs because sticking materials, such as fused toner and the like, adhere to the fixing roller when the surface of the fixing roller directly contacts the toner image. When offset occurs, the toner adhering to the fixing roller as a result of offset is fed on the roller, and adheres again to the recording material P, causing contamination of the image. Hence, it is necessary to prevent the offset phenomenon in such a fixing device.

As one method for reducing or preventing the offset phenomenon, there is a method in which potential on the surface of the fixing roller is controlled. In this method, the mechanism of the occurrence of offset is investigated, and from the viewpoint that offset occurs due to an electrostatic force at the fixing portion, the electrostatic force is controlled. Offset is a phenomenon which occurs due to the transfer of toner from the recording material P to the fixing roller 1. The forces causing the transfer and to be considered are electrostatic forces on the toner in the direction of the fixing roller and adhesion force due to the tackiness of the toner. That is, in a conventional hot-roller fixing device as shown in FIG. 5, in general, the fixing roller 1 is negatively charged at ten volts to several hundreds volts, the pressing roller is charged at a higher potential of several hundred volts to several tens of thousands of volts, and the recording material P has positive electric charges. As a result of the above-described potential relationship, an electrostatic force is exerted between the toner and the fixing roller.

For example, when fixing positively-charged toner, if the triboelectrification potential between the fixing roller and the recording material is high and the surface potential of the pressing roller is low, a strong electrostatic attractive force is exerted between the fixing roller and the toner, and the toner adheres to the fixing roller.

When fixing negatively-charged toner, if the potential of the fixing roller is low and the negative potential of the pressing roller is high, a strong electrostatic repulsive force is exerted between the pressing roller and the toner, and the toner adheres to the fixing roller.

Methods for preventing or effectively utilizing the above-described electrostatic forces have been considered.

In Japanese Laid-Open Patent Application No. 55,374/1980, a method has been disclosed in which, by disposing corona discharge units facing outer circumferential surface of rollers, or by making contact biasing rollers, charge-removing cloths or the like with outer circumferential surfaces of rollers, electric charges on either a fixing roller or a pressing roller are removed to reduce offset.

However, if the potential of a roller is controlled from the outer circumferential surface of the roller, the potential is apt to be influenced by changes in environment. In addition, the configuration of the device becomes large.

In consideration of the above-described disadvantages, in Japanese Patent Public Disclosure (Kokai) Publication No. 55-96970 (1980), a biasing voltage is applied to a core bar of a roller to prevent offset.

In U.S. patent application Ser. No. 446,426, filed Dec. 5, 1989, and assigned to the assignee of this application, the core bar is grounded via a diode.

Although the above-described application of a biasing voltage to the core bar is effective for the prevention of offset in some cases, offset has not been sufficiently prevented in cases where the triboelectrification potential of the surface of the roller is high.

For example, in Japanese Patent Public Disclosure (Kokai) Publication Nos. 54-2137 (1979), 57-150869 (1982) and 58-209769 (1983), there are descriptions of reducing resistance values of fixing and pressing rollers to reduce triboelectrification of the rollers.

These approaches are, however, for reducing electrostatic influences, and there has been no description about the prevention of offset utilizing an electrostatic force.

If the surface of the above-described roller having a low resistance value is microscopically observed, resin or rubber and conductive powder are merely mixed. Hence, the above-described approaches still have the problem that toner particles contacting resin portions receive electrostatic attractive forces, causing offset.

SUMMARY OF THE INVENTION

It is an object of the present invention to provide a fixing device capable of preventing offset utilizing an electrostatic force.

It is another object of the present invention to provide a fixing device in which a biasing voltage is applied to a conductive base material of a feed member for fixing.

In one embodiment, the fixing device of the present invention includes a fixing feed member for performing a fixing operation by grasping and feeding a supporting material on which an unfixed toner image resides. The fixing feed member includes a conductive base material and a surface release layer provided on the base material. There is also included a voltage application means for applying a biasing voltage to the conductive base material. The surface release layer contains a conductive material therein.

In another embodiment of the fixing device of this invention, there is provided a fixing roller for grasping and feeding a recording medium having on its image side an unfixed toner image. The fixing roller is made of a conductive base and a surface release layer on top of the base, the surface release layer containing a conductive material. A pressing feed roller is provided in pressure contact with the fixing roller and a biasing voltage is applied to the conductive base material in the fixing roller.

In still another aspect of the invention, there is provided a fixing roller for use in a fixing device. The fixing roller includes a heater, a conductive base material and a surface release layer provided on the conductive base member. Also provided is a mechanism for supplying a biasing voltage to the conductive base member.

These and other objects of the present invention will become more apparent from the following description.

DESCRIPTION OF THE PREFERRED EMBODIMENTS

Embodiments of the present invention will now be explained by reference to the drawings.

Figure 5:
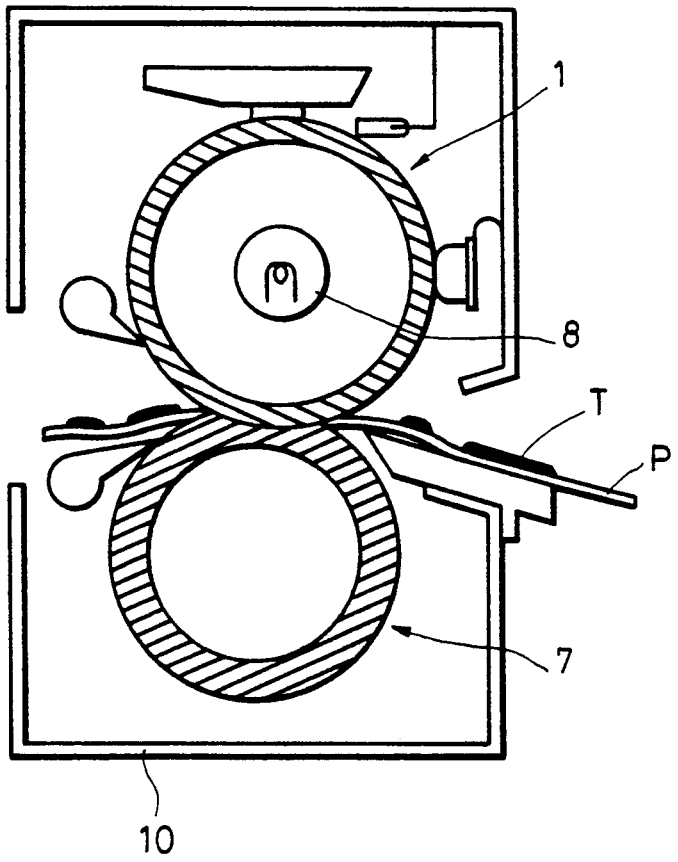
FIG. 5 (PRIOR ART)
FIG. 5 is a cross-sectional view showing the schematic configuration of a conventional fixing device.

In the drawings, like components as those in FIG. 5 are indicated by like numerals, and an explanation thereof will be omitted.

FIRST EMBODIMENT

First, a first embodiment will be explained by reference to FIGS. 1 through 3.

Figure 1:
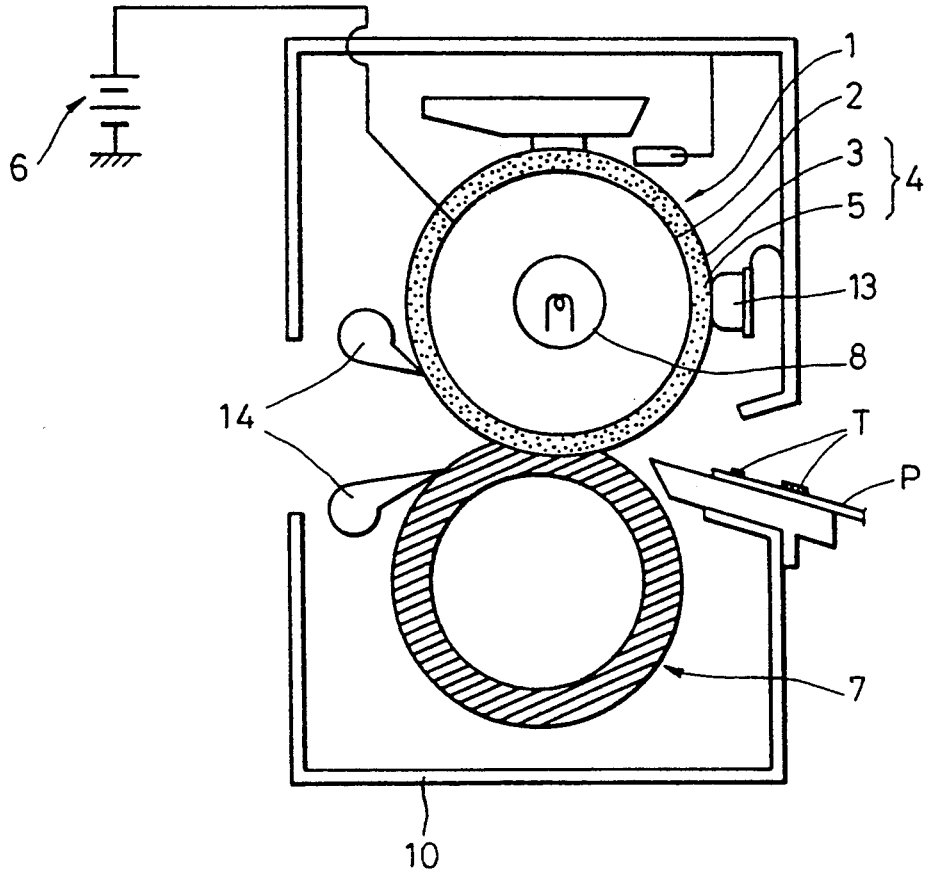
FIG. 1 is a cross-sectional view showing the schematic configuration of a fixing device according to a first embodiment of the present invention.
Figure 2:
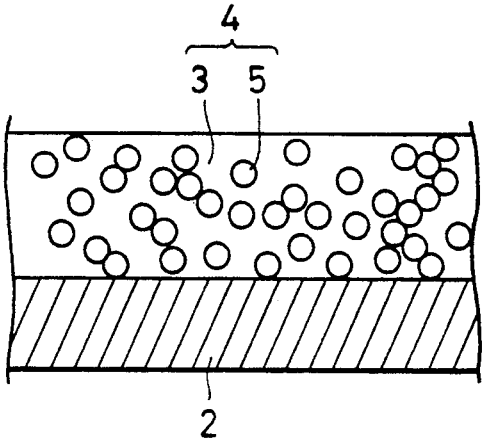
FIG. 2 is an enlarged view of the cross section of the surface layer of the fixing roller in the FIG. 1 device.

In FIG. 1, the fixing roller 1 contacts an undeveloped image T made of toner particles. The fixing roller 1 is composed of a cylindrical core bar 2 made of a conductor having an excellent heat-conductive property, such as Al, Fe or the like, and having thereon a coated layer 4 about 30 μm thick. The coated layer 4 serves as a surface release layer having fluororesin 3 as a matrix. The coated layer 4 is made of PTFE, PFA or a mixture thereof and, as shown in FIG. 2, contains a conductive material 5 which is a semiconductive substance or a heat-resistant conductive substance, such as metal powder or the like. The content of the conductive material 5 is adjusted so that the volume resistance of the coated layer 4 is $10^6$ Ω.cm–$10^{13}$ Ω.cm.

A thermistor 13 detects the surface temperature of the fixing roller 1. The surface of the fixing roller 1 is maintained at a predetermined temperature by controlling current supplied to the heating source 8 according to the output from the thermistor 13.

Separation pawls 14 prevent the recording material from being wound around the fixing roller 1 or the pressing roller 7.

In the fixing device of the present invention using the above-described fixing roller 1, a biasing power supply 6, serving as voltage application means for applying a biasing voltage having the same polarity as that of the toner, is connected to the core bar 2. The polarity of the biasing voltage is positive if the charging polarity for the toner is positive, and a biasing voltage of about +1 kV (kilovolts) may be applied.

Next, the function of the prevention of offset in the device of the embodiment will be explained by reference to FIG. 3.

Figure 3:
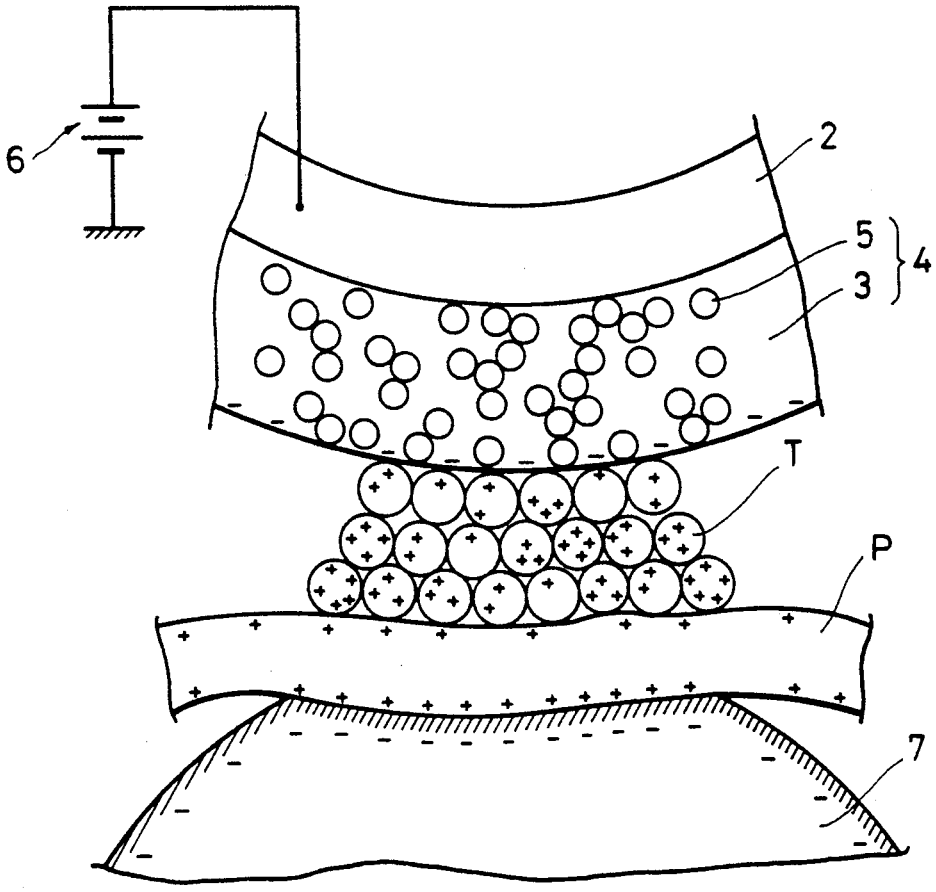
FIG. 3 is an enlarged view around a nip portion of the fixing device of FIG. 1.

FIG. 3 is an enlarged view of a contact portion (nip portion) between the fixing roller 1 and the recording material P having the toner image T. In the coated layer 4 of the fixing roller 1, the conductive material 5 is dispersed within the fluororesin 3 consisting of PTFE. Usually, PTFE is negatively charged due to friction with the recording material (paper in particular), and the recording material is positively charged.

If the coated layer 4 is insulating, negative electric charges accumulate on the surface of the roller, and the potential of its surface is remarkably increased (several hundreds volts in some cases). In the present embodiment, however, since the conductive material 5 exists within PTFE, negative electric charges on the surface of the roller 1 are transferred to the core bar 2 via the conductive material 5. Furthermore, since a positive voltage is applied to the core bar 2, the transfer of the negative electric charges to the core bar 2 is facilitated, decreasing the negative electric charges on the surface of the roller 1. On the other hand, the entire fixing roller 1 is maintained at a positive potential due to the biasing voltage. As a result, an electrostatic repulsive force is exerted on the toner T from the side of the fixing roller 1, reducing the amount of transfer of the toner T to the fixing roller 1. Thus, offset is reduced.

In the case of a high-resistance coated layer 4 consisting only of PTFE, even if a biasing voltage is applied to the core bar 2 to provide a positive potential, negative electric charges accumulated on the surface of the roller 1 are not transferred to the core bar 2. Hence, an electrostatic attractive force is exerted between the negative electric charges on the surface of the roller 1 and the toner T. Alternatively, the negative electric charges are injected into the toner T to partially produce negatively-charged toner particles, and so an electrostatic attractive force is exerted between the negatively-charged toner particles T and the positively-biased roller 1. In either case, offset is not satisfactorily prevented.

As described above, when a biasing voltage is to be applied to the core bar 2 of the roller 1, it is very effective to mix a conductive substance in the surface release layer to lower its resistance value. However, if the resistance value of the surface release layer is too low, the use of electrostatic force to prevent offset becomes less effective.

That is, if the volume resistance of the fixing roller is set to a value lower than $10^6$ Ω.cm and a biasing voltage is applied, although almost all negative electric charges on the roller disappear, positive electric charges supplied from the biasing power supply reach the surface of the roller via a large number of dispersed particles of the conductive material, and a part of the electric charges is injected into the toner particles. Electric charges on the toner particles are increased, and electrostatic repulsive forces between the toner particles are increased. Thus, disturbance in the image due to dispersion of the toner particles, and adhesion of a part of the toner particles to the fixing roller occurs. As a result, the effect of the prevention of offset is reduced, or disturbance in the image occurs even if offset can be suppressed.

Accordingly, when a biasing voltage is applied to the core bar of the fixing roller, it is desirable to set the value of the volume resistance of the coated layer to the value $10^6$-$10^{13}$ Ω.cm.

The material for forming the surface release layer is not limited to fluororesins, such as PTFE, PFA or the like, but may also include silicone, flurorubber or the like, irrespective of the polarity of the toner.

EXPERIMENTAL EXAMPLE

Next, an explanation will be provided of an experiment in which a comparison was performed by changing the amount of the conductive material to be contained in the surface layer.

Three kinds of fixing rollers were prepared. Each had coated layers about 30 μm thick and comprised (1) only PFA, (2) PFA mixed with 3 weight % of carbon and (3) PFA mixed with 10 weight % of carbon were prepared. The occurrence of offset was observed in each case while changing the biasing voltage applied to the core bar. Single-component toner having a positive charging characteristic was used, and the experiment was performed using an NP-1215 copier (product of Canon Inc.). The results are shown in Table 1. In the samples made of (1) only PFA, only a slight effect was observed even if a biasing voltage of +1.0 kV was applied, and no remarkable effect was observed even if higher voltages were applied. In the samples in which 10 wt % of carbon was mixed, although the level of offset was ordinary because the roller was hardly charged as has been known, no remarkable effect was observed even if a biasing voltage was applied. Instead, offset was increased and dispersion of toner particles on the image was observed, as described above, at the side of higher voltages. In contrast to the above-described two cases, in the samples in which 3 weight % of carbon was mixed, it was confirmed that the effect of the reduction of offset due to the application of a biasing voltage was remarkable compared with a conventional case in which the core bar was grounded, and reached best and satisfactory levels in the range of +500 V-1000 V. As a result of obtaining detailed data on the value of the resistance of the roller, it was confirmed that the biasing voltage can be set to a value for providing an excellent level of offset if the value of the volume resistivity is $10^6$ Ω.cm or more.

TABLE 1

| Biasing Voltage | (1) Only PFA | (2) 3 weight % | (3) 10 weight % |
|---|---|---|---|
| 0 V (Core bar grounded) | XX | X | Δ~X |
| +200 V | X | ○ | Δ |
| +500 V | X | ◎ | Δ* |
| +1.0 kV | Δ | ◎ | X* |
| Volume Resistivity | $10^{14}$Ω · cm | $10^9$Ω · cm | $10^5$Ω · cm |

TABLE 1-continued

| Biasing Voltage | (1) Only PFA | (2) 3 weight % | (3) 10 weight % |
|---|---|---|---|
| | or more | | |

◎—Very good. No offset occurred.
○—Good. Little offset occurred.
Δ—Ordinary. Offset was reduced a small amount.
X—Bad. Offset was only slightly reduced.
XX—Very bad. Offset was not prevented at all.
*—Dispersed disturbance occurred in the image.

SECOND EMBODIMENT

Figure 4:
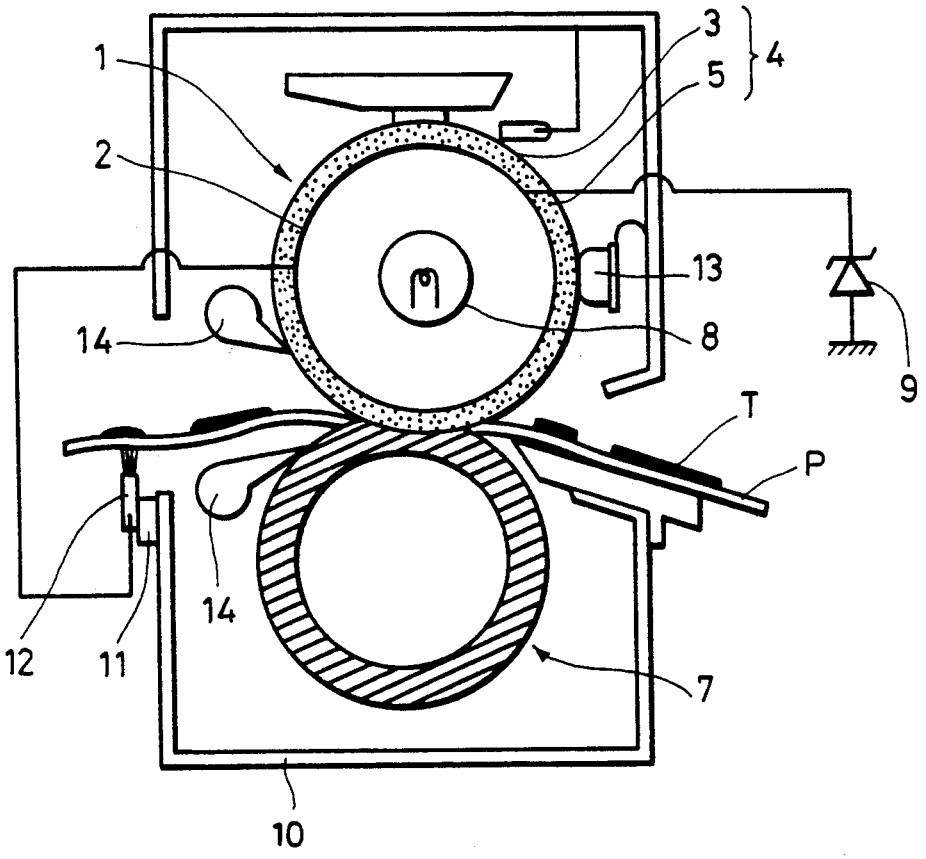
FIG. 4 is a cross-sectional view showing the schematic configuration of a fixing device according to a second embodiment of the present invention.

Next, an explanation will be provided of a second embodiment of the present invention by reference to FIG. 4. In FIG. 4, like components as those in the first embodiment are indicated by like numerals, and an explanation thereof will be omitted.

The present embodiment differs from the first embodiment in that a biasing voltage is applied by maintaining the voltage using a voltage regulation device 9 or a rectifying device in place of the biasing power supply 6 as voltage application means. Since paper is very positively charged if silicone-type or fluorine-type rubber or resin is used on the surface of the pressing roller, a method has been used in which electric charges on the paper after being discharged from a pair of rollers are removed by charge-removing needles 12 made of carbon fibers or the like to stabilize the paper-feed operation. In the present embodiment, electric charges as a result of the charge-removing operation are utilized for producing a biasing voltage.

As shown in FIG. 4, charge-removing needles 12 disposed on the frame 10 interposing an insulator 11 are connected to the core bar 2 of the fixing roller 1, and the core bar 2 is grounded via a voltage regulation device 9 (a varistor in the present embodiment). In such a configuration, positive electric charges from the paper are leaked via the core bar 2 and the voltage regulation device 9. The core bar 2 of the fixing roller is maintained at a positive potential according to characteristics of the the voltage regulation device 9. That is, since a positive biasing voltage is applied to the core bar 2 of the fixing roller as in the first embodiment, the same effect of the reduction of offset as in the first embodiment may be obtained for toner having a positive charging characteristic. According to an experiment, sufficient reduction of offset could be confirmed when a varistor having a rated voltage of 500 V-1000 V and a fixing roller in which 3 weight % of carbon was mixed as in case (2) in the foregoing experimental example were used. The device to be used is not limited to a varistor, but a rectifying device having a high impedance, such as a Zener diode, a diode or the like, may be properly selected.

The present embodiment is not limited to toner having a positive charging characteristic. If the charge-removing needles 12 are disposed near the pressing roller 7 to collect negative electric charges on the surface of the pressing roller 7, and are grounded via the core bar 2 of the fixing roller 1 and the varistor 9, the core bar 2 of the fixing roller 1 is negatively charged, and reduction of offset in toner having a negative charging characteristic may be achieved.

By thus utilizing electric charges removed from paper in the feed path, it becomes possible to reduce electrostatic offset without using a biasing power supply.

The release layer is usually bonded on the core bar using a primer. Although a primer having a high volume resistivity may be used since the layer is thin, it is preferred to use a primer having a volume resistivity of $10^6$–$10^{13}$ Ω.cm.

As explained above, according to the present invention, since a biasing voltage applied to the conductive base material of the feed member effectively appears on the surface of the release layer, the applied biasing voltage effectively achieves the prevention of offset.

The feed member is not limited to have the shape of a roller, but may also have the shape of a belt or the like.

While the present invention has been described with respect to what is presently considered to be the preferred embodiments, it is understood that the invention is not limited to the disclosed embodiments. The present invention is intended to cover various modifications and equivalent arrangements included within the spirit and scope of the appended claims.

What is claimed is:

1. A fixing device comprising:

a fixing feed member comprising an electrically conductive layer and a releasing surface layer on the electrically conductive layer, said fixing feed member contactable to an unfixed toner image on a supporting material, and said releasing surface layer having a volume resistivity of from $10^6$ to $10^{13}$ Ωcm;

a back up member;

said fixing feed member and said back up member being arranged for grasping and feeding the supporting material supporting said unfixed toner image and for fixing said unfixed toner image; and a facilitating means for facilitating a transfer of electric charges, having a polarity opposite to the polarity of said unfixed toner image, from the surface of said releasing surface layer to said electrically conductive layer.

2. A fixing device according to claim 1, wherein said releasing surface layer is comprised of a releasing material and an electrically conductive material.

3. A fixing device according to claim 1, further comprising a heater for heating said fixing feed member.

4. A fixing device according to claim 1, wherein said facilitating means comprises bias voltage applying means for applying a bias voltage having a polarity identical to the polarity of said unfixed toner image to said electrically conductive layer.

5. A fixing device according to claim 4, wherein said bias voltage applying means comprises a bias power supply.

6. A fixing device according to claim 4, wherein said bias voltage is more than 500 V.

* * * * *